US007503466B2

(12) United States Patent
Ramet

(10) Patent No.: US 7,503,466 B2
(45) Date of Patent: Mar. 17, 2009

(54) PUMP AND RECEPTACLE FITTED THEREWITH

(75) Inventor: Marc Ramet, Asnieres (FR)

(73) Assignee: L'Oreal, Paris (FR)

( * ) Notice: Subject to any disclaimer, the term of this patent is extended or adjusted under 35 U.S.C. 154(b) by 407 days.

(21) Appl. No.: 10/819,985

(22) Filed: Apr. 8, 2004

(65) Prior Publication Data

US 2004/0217133 A1 Nov. 4, 2004

Related U.S. Application Data

(60) Provisional application No. 60/470,493, filed on May 15, 2003.

(30) Foreign Application Priority Data

Apr. 11, 2003 (FR) ..... 03 04591

(51) Int. Cl.
*B65D 88/54* (2006.01)

(52) U.S. Cl. ..... 222/321.9; 222/321.7; 222/341

(58) Field of Classification Search ..... 222/321.7, 222/385, 321.9, 332, 375–376, 383.1, 340–341, 222/321.2; 239/333
See application file for complete search history.

(56) References Cited

U.S. PATENT DOCUMENTS 580,948 A 4/1897 Montgomerie
3,185,354 A * 5/1965 Lipman ..... 222/321.2
3,583,605 A * 6/1971 Corsette ..... 222/321.9
3,877,616 A * 4/1975 Stevens ..... 222/321.9
4,017,031 A * 4/1977 Kishi et al. ..... 239/333
4,174,790 A 11/1979 Nozawa et al.
4,365,729 A * 12/1982 Saito et al. ..... 222/321.2
4,958,752 A * 9/1990 Maerte et al. ..... 222/321.4
5,622,286 A 4/1997 Renault
5,947,340 A * 9/1999 Arnold et al. ..... 222/321.9
6,595,395 B2 * 7/2003 Jourdin et al. ..... 222/321.9
7,040,511 B1 * 5/2006 Petit ..... 222/189.09

FOREIGN PATENT DOCUMENTS

FR 2 528 122 12/1983
JP 2002273278 9/2002

* cited by examiner

*Primary Examiner*—Frederick C. Nicolas
(74) *Attorney, Agent, or Firm*—Oliff & Berridge, PLC

(57) ABSTRACT

A pump for fixing on a receptacle includes: a stationary portion including a pump body; a moving assembly movable relative to the pump body and co-operating therewith to define a variable-volume pump chamber; an opening in the pump body that enables the pump chamber to communicate with the inside of the receptacle and enables the pump to operate in a head-down position; an air intake passage, distinct from the opening, between the stationary portion and the moving assembly; a first lip configured to press in a leaktight manner against the pump body and to prevent communication via the opening between the inside of the receptacle and the pump chamber; and a second lip arranged, at least when the moving assembly is in an end-of-stroke position, to prevent communication through the inside of the pump body and via the opening between the inside of the receptacle and the outside.

47 Claims, 2 Drawing Sheets

PUMP AND RECEPTACLE FITTED THEREWITH

CROSS-REFERENCE TO RELATED APPLICATION

This application claims the benefit of French Application No. 03 04591 filed on Apr. 11, 2003 and U.S. Provisional Application No. 60/470,493 filed on May 15, 2003, the entire disclosure of which is incorporated by reference herein.

FIELD OF INVENTION

The present invention relates to a pump for mounting on a receptacle to enable a substance to be dispensed while the receptacle is in different positions, such as a head-up position and/or a head-down position.

BACKGROUND

French patent application FR 2,528,122 discloses a pump that enables substance to be dispensed while the pump is either head-up or head-down. The pump comprises a pump body and a moving assembly in the pump body that co-operates therewith to define a pump chamber of variable volume. The pump body includes an opening that enables the substance contained in the receptacle to penetrate into the pump chamber while the pump is in use head-down. The moving assembly includes a lip that enables the opening to be isolated from the pump chamber after the lip has been engaged by a certain amount in the pump body. If the pump is kept head-down over a long period, there possibility exists that the substance might leak out through the opening, particularly if the substance is not very viscous.

SUMMARY OF THE INVENTION

Exemplary embodiments of the invention provide a pump of relatively simple structure that enables a substance to be dispensed in satisfactory manner with the pump head-up or head-down, and even if the substance is not very viscous.

In an exemplary embodiment, the invention provides a pump for fixing on a receptacle, the pump comprising: a stationary portion including a pump body; a moving assembly movable relative to the pump body and co-operating therewith to define a pump chamber of variable volume; at least one opening in the pump body enabling the pump chamber to communicate with the inside of the receptacle and disposed in such a manner as to enable the pump to operate in a head-down position; an air intake passage between the stationary portion and the moving assembly, the passage being distinct from the opening; a first lip arranged, after displacement of the moving assembly from a rest position in a substance-dispensing direction, to press in a leaktight manner against the pump body and to prevent communication via the opening between the inside of the receptacle and the pump chamber; and a second lip situated above the first lip when the pump is observed in a head-up position, the second lip being arranged, at least when the moving assembly is in an end-of-stroke position inside the pump body, to press in a leaktight manner against the pump body and prevent communication via the inside of the pump body and the opening between the inside of the receptacle and the outside.

Exemplary embodiments of the invention make it possible to provide a pump with an air intake passage which can extend at least in part within the pump body, for example, by a clearance formed between a rod of the moving assembly and the stationary portion. This may help to avoid the need to use sealing means that would be complex and expensive to implement between the rod and the stationary portion.

When air intake takes place via clearance between the rod and the stationary portion, exemplary embodiments of the invention also make it possible to reduce the risk of substance leaking in the event of the pump being kept head-down, whether at rest or when the moving assembly is in an end-of-stroke position inside the pump body, since the second lip may prevent the substance entering via the opening from passing via the pump body to reach the air intake passage and then flow out from the pump.

In exemplary embodiments, the pump may preferably include an annular gasket for placing between the stationary portion and a top end of a neck of the receptacle on which the pump is mounted, the gasket including a radially-inner portion which may firstly press against the pump body to prevent the substance contained in the receptacle from flowing towards the outside, and secondly may move away therefrom under the effect of suction inside the receptacle in order to allow ingress of air. In various exemplary embodiments, the gasket does not press on the pump body. However, the clearance between the gasket and the pump body is then sufficiently small to prevent the substance from passing, while still allowing air to pass.

In an exemplary embodiment of the invention, the pump has a base portion that enables the pump to be secured to the receptacle, the pump body being held, for example, by snap-fastening, on the base portion.

In exemplary embodiments, the air intake passage may be formed at least in part between the base portion and the pump body.

In an exemplary embodiment of the invention, at least one of the first and second lips is arranged to press continuously against the pump body. Both lips may preferably press continuously against the pump body.

The first lip may be substantially frustoconical in shape, flaring toward the pump chamber, and the second lip may be arcuate in shape with its concave side towards an inside surface of the pump body, pressing against the pump body via bottom and top edges.

In exemplary embodiments in which the pump is a precompression pump, the moving assembly may include a shutter arranged to close a passage for delivering the substance while the volume of the pump chamber is increasing, and to release the passage while the volume of the pump chamber is decreasing, and once the pressure of the substance inside the pump chamber has reached a predetermined value.

It should be understood that the present invention contemplates that the pump may be another precompression mechanism, or may not be a precompression pump.

In exemplary embodiments, the moving assembly may include an inside space into which the substance outlet passage opens out and in which the shutter is disposed.

The shutter may comprise a tubular body closed at a top end thereof by a substantially frustoconical portion suitable for closing the substance outlet passage.

The shutter may also include an annular lip on the outside of the tubular body suitable for pressing against a wall that defines the inside space. When the pump is observed in the head-up position, the annular lip may have a shape that is substantially frustoconical diverging upward and situated beneath the passage(s) putting the inside space into communication with the pump chamber.

The shutter may be urged toward a closed position thereof by a resilient return element disposed in the inside space. The resilient return element may comprise a helical spring working in compression, for example.

In advantageous exemplary embodiments, the pump may include a resilient return element suitable for returning the moving assembly into a rest position thereof. Such a resilient return element may be disposed inside the pump chamber and may comprise a helical spring working in compression. It should be understood that the present invention contemplates that the return element may be disposed outside the pump chamber, particularly if it is desired to avoid contacting the return element with the substance.

In an exemplary embodiment of the invention, the pump body is arranged to enable a dip tube to be fixed thereto.

In exemplary embodiments in which the pump includes a suction check valve that closes while the volume of a front chamber is decreasing and that opens while the volume of the pump chamber is increasing, the check valve may be disposed in such a manner as to enable the pump chamber to be fed with substance via the dip tube when the pump is used in a head-up position.

Exemplary embodiments of the invention also provide a receptacle fitted with a pump as described above.

BRIEF DESCRIPTION OF THE DRAWINGS

The invention can be better understood on reading the following detailed description of non-limiting embodiments thereof, and on examining the accompanying drawings, in which.

DETAILED DESCRIPTION OF EXEMPLARY EMBODIMENTS

Figure 1:
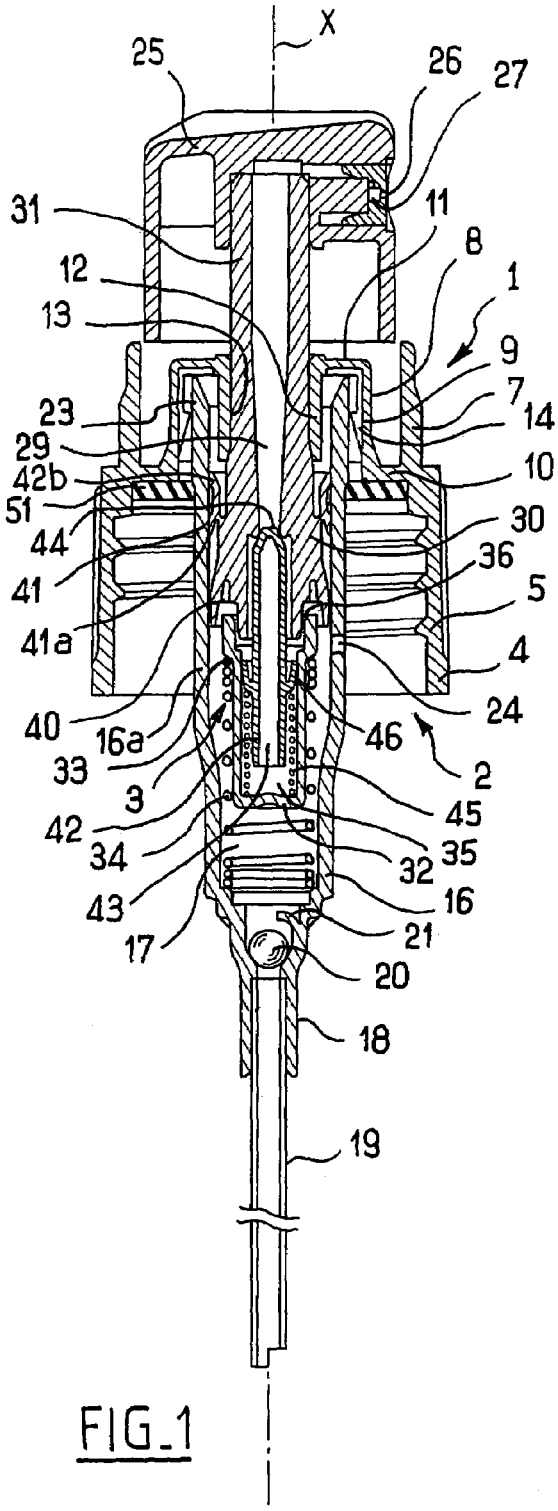
FIG. 1 is a diagrammatic and fragmentary axial section view of an exemplary embodiment of a pump according to the invention, the moving assembly being shown in a rest position.
Figure 2:
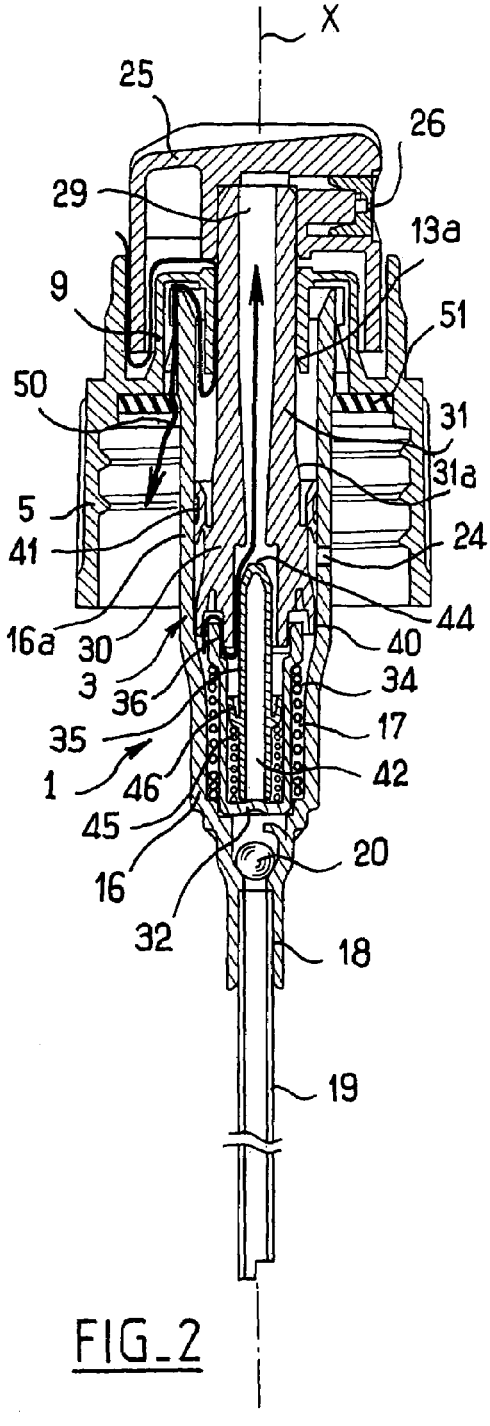
FIG. 2 is a diagrammatic and fragmentary axial section view of the exemplary embodiment of FIG. 1, after the pushbutton has been depressed.
Figure 3:
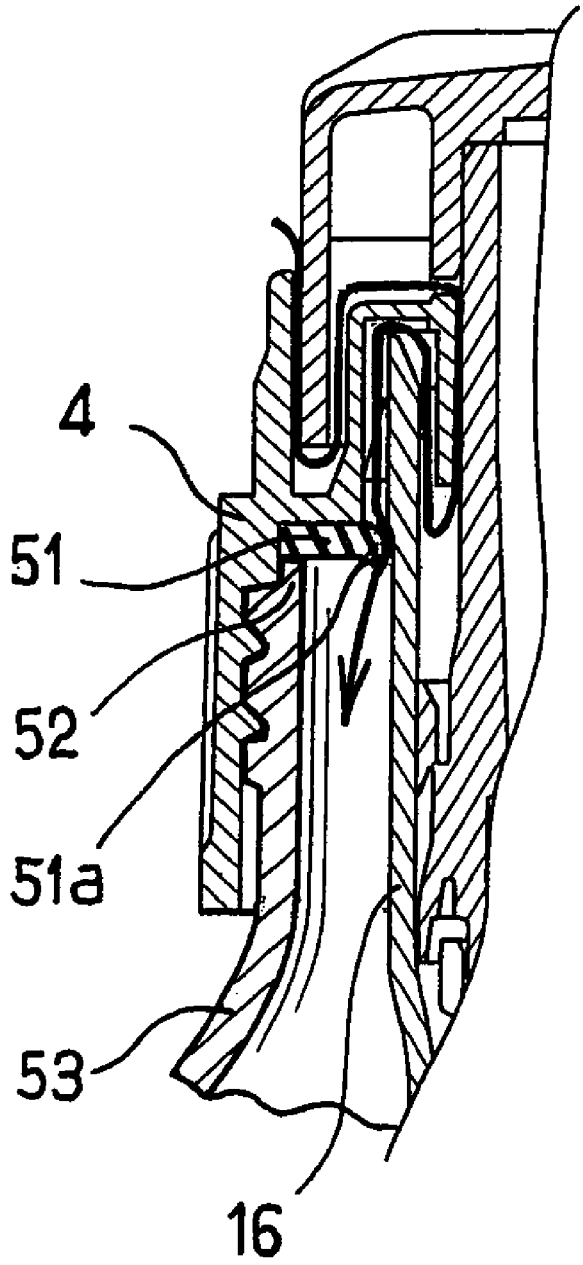
FIG. 3 is a diagrammatic and fragmentary sectional view showing the pump of FIG. 2 in more detail.

The pump 1 shown in FIGS. 1 and 2 is for mounting on a neck 52 of a receptacle 53 (shown in FIG. 3). The receptacle may contain a substance for dispensing, for example, a substance having low viscosity, such as a perfume.

The pump 1 comprises a stationary portion 2 and a moving assembly 3 capable of moving relative to the stationary portion 2 along an axis X.

The stationary portion may have a base portion 4 with an internally threaded assembly skirt 5 for securing to the neck 52 of the receptacle 53 (as shown in FIG. 3) by screw fastening, for example. It should be understood that the present invention contemplates that the base portion 4 may be fixed to the neck of the receptacle in some other manner, such as, for example, by snap-fastening, adhesive, heat-sealing, or crimping.

The stationary portion 2 further comprises a pump body 16 co-operating with the moving assembly 3 to define a pump chamber 17 of variable volume.

The moving assembly 3 may comprise a piston 30 made integrally, i.e., monolithically, with a hollow rod 31 having a top end with a pushbutton 25 secured thereto.

The assembly skirt 5 may be extended upward by a neck 7 that surrounds a central portion 8 of the base portion 4. The central portion 8 may comprise two coaxial tubular walls 9 and 12 interconnected by an annular wall 11 at their top end, thereby defining a downwardly open annular groove in which the pump body 16 may be engaged.

At a bottom end thereof, the central portion 8 may be connected to the neck 7 by an annular wall 10 that extends perpendicularly to the axis X.

The radially-inner tubular wall 12 defines a passage 13 for the rod 31 of the moving assembly 3. At a bottom end thereof, the passage 13 defines a downwardly flaring frustoconical surface 13*a* about the axis X that comes to bear in a leaktight manner against a corresponding frustoconical surface 31*a* of the rod 31 that converges upward when the pump is at rest, as shown in FIG. 1.

The radially-outer tubular wall 9 may have a bead 14 on a radially inside face thereof that enables the pump body 16 to be snap-fastened to the base portion 4. for example, the pump body 16 may be provided with an annular bead 23 at a top end thereof for this purpose.

The base portion 4 may carry an annular gasket 51 for interposing between the annular wall 10 and a top end of the neck 52 of the receptacle 53, as shown in FIG. 3.

A radially-inner portion 51*a* of the gasket 51 may normally press against the pump body 16 to prevent the substance contained in the receptacle from flowing outward.

In the exemplary embodiment shown, the pump body 16 has a circularly cylindrical portion 16*a* about the axis X, and has an endpiece 18 at a bottom end thereof for use in securing a dip tube 19.

The endpiece 18 may define a seat for a suction check valve comprising a ball 20. The ball may be retained in a housing by at least one tab 21 of the pump body 16.

In accordance with the exemplary embodiment of the invention shown, the pump body 16 has an opening 24 situated substantially halfway up the pump body. The opening enables the pump chamber 17 to be put into communication with the inside of the receptacle when the moving assembly 3 is at rest, the volume of the pump chamber then being at its maximum.

The pushbutton 25 may include a dispenser orifice 26, such as one implemented by a conventional nozzle having swirling channels 27 fitted onto the remainder of the pushbutton. Such nozzle enables the substance to be dispensed in the form of a spray.

The rod 31 may have a channel 29 that enables the substance to reach the orifice 26.

In the exemplary embodiment shown, the piston 30 has a first annular lip 40 and a second annular lip 41.

The first lip 40 may be substantially frustoconical in shape, diverging toward a bottom of the pump chamber 14 and pressing in a leaktight manner against an inside surface of the cylindrical portion 16*a* of the pump body 16. The first lip 40 may be situated above the opening 24 when the pump is in a rest position, as shown in FIG. 1.

The second annular lip 41 may be situated above the first lip 40, and may also press in a leaktight manner against the inside surface of the cylindrical portion 16*a* of the pump body 16. In the exemplary embodiment shown, the second lip 41 has an arcuate shape with a concave side facing toward the inside surface of the body 16, and presses against the body 16 via bottom and top edges 41*a* and 42*b*.

The rod 31 may be extended downward by a hollow endpiece 32 that is closed at a bottom end thereof.

For example, the endpiece 32 may be secured to the rod 31 by snap-fastening and may include an outside shoulder 33 against which a top end of a helical spring 34 operating in compression may bear. A bottom end of the spring 34 may rest against a bottom of the pump body 16.

Passages 36 may be made between the pump chamber 17, outside the endpiece 32, and the inside space 35 of the endpiece so as to enable the substance contained in the pump chamber 17 to reach the channel 29 while the volume of the pump chamber 17 is decreasing.

In the inside space 35, the moving assembly 3 may include a shutter 42 that is movable between a closed position that closes the channel 29 and a dispensing position that enables the substance to flow into the channel 29 and to the orifice 26.

The shutter 42 may comprises a tubular body 43 of axis X that is closed at a top end thereof by a frustoconical portion 44 suitable for bearing against a seat made in the rod 31 to close the channel 29 when the pump is at rest, as shown in FIG. 1.

The shutter 42 may also comprise an annular lip 46 outside the tubular body 43 suitable for pressing against the inside surface of the endpiece 32.

When the pump is observed in a head-up position, the annular lip 46 may have a frustoconical shape that diverges upward, and may be positioned beneath the passages 36 putting the inside space 35 into communication with the pump chamber 17.

A helical spring 45 working in compression may be used to urge the shutter 42 into the closed position at rest, as shown in FIG. 1. The spring 45 may have a bottom end bearing against the end wall of the endpiece 32 and may have a top end bearing against the base of the lip 46.

While there is suction inside the receptacle, air can be sucked into the receptacle by flowing between the neck 7 and the pushbutton 25. While the pushbutton is depressed, air can flow into the receptacle by flowing through the clearance that exists between the rod 31 and the tubular wall 12, between the wall 12 and the pump body 16, between the annular wall 11 and the body 16, and then between the tubular wall 9 and the pump body 16, and finally between the gasket 51 and the body 16.

FIG. 2 illustrates the exemplary air intake path 50.

Between the tubular wall 9 and the body 16, air can flow via diametrically-opposite axial grooves made through the bead 14. The radially-inner portion 51*a* of the annular gasket 51 may move away a little from the pump body 16 so as to allow the air flowing between the tubular wall 9 and the pump body 16 to reach the inside of the receptacle, as shown in FIG. 3.

The pump 1 may operate as follows.

It is assumed that the pump 1 is being used in the head-up position, and is initially in the rest position as shown in FIG. 1. It is also assumed that the pump chamber 17 is full of substance, following an earlier cycle in which the pump has been actuated.

In order to dispense the substance, a user exerts downward pressure on the pushbutton 25, and the moving assembly 23 moves relative to the pump body 16 so that the pressure of the substance contained in the pump chamber 17 increases, with the ball 20 being pressed against its seat.

The shutter 42 remains in the position closing the channel 29 until the pressure of the substance in the inside space 35 above the annular lip 46 is sufficient to overcome the return force of the spring 45.

Once the moving assembly 3 has been depressed sufficiently, the pressure exerted by the substance on the lip 46 causes the shutter 42 to move downward, thereby opening access to the channel 29.

Continued displacement of the moving assembly 3 relative to the pump body 16 causes the substance contained in the pump chamber 17 and in the inside space 35 to be expelled.

During this continued displacement, the first lip 40 isolates the pump chamber 17 from the opening 24 and the second annular lip 41 serves to isolate the opening 24 of the air intake passage.

During the displacement of the moving assembly 3, the spring 34 is compressed.

When the user ceases to press on the pushbutton 25, the spring 34 drives the moving assembly 3 upward and the spring 45 returns the shutter 42 into the position in which the shutter 42 closes the channel 29.

Continued upward movement of the moving assembly 3 relative to the pump body 6 is accompanied by substance being sucked into the pump chamber 17 under the effect of the suction that is created therein.

Air intake can take place along the path 50 in order to compensate inside the receptacle for the volume of substance that is taken by the pump 1.

When the pump 1 returns to the rest position, some substance may remain inside the pump chamber 17 because the ball 20 tends, under the effect of its own weight, to press against its seat and close off communication between the dip tube 19 and the pump chamber 17.

When the pump 1 is used in the head-down position, the pump chamber 17 can fill via the opening 24 because air can escape via the dip tube 19. Substance may be dispensed in the head-down position in the same manner as in head-up position.

When the pump 1 is in the head-down position and at rest, the fact that the first lip 40 presses in a leaktight manner against the pump body 16 serves to avoid any risk of substance leaking out through the clearance that exists between the rod 31 and the central portion 8 of the base portion 4.

Because the second lip 41 presses against the pump body 16, the risk of substance leaking out is also prevented or reduced if the pump is in the head-down position with the moving assembly 3 in its end-of-stroke position.

A pump according to the invention can advantageously be made out of pump parts with or without air intake, for example, those sold under the reference M300 by the supplier Calmar, a subsidiary of Saint-Gobain.

Naturally, the invention is not limited to the exemplary embodiments described above.

In particular, the pump body may have not one, but several openings 24.

Throughout the description, including in the claims, the term "comprising a" should be understood as being synonymous with "comprising at least one", unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A pump for fixing on a receptacle, the pump comprising:

a stationary portion comprising a pump body;

a moving assembly movable relative to the pump body and co-operating therewith to define a pump chamber of variable volume;

at least one opening in the pump body that enables the pump chamber to communicate with an inside of the receptacle and is configured to enable the pump to operate in a head-down position;

an air intake passage between the stationary portion and the moving assembly, said intake passage being distinct from said at least one opening;

a first lip configured, after displacement of the moving assembly from a rest position in a substance-dispensing direction, to press in a leaktight manner against the pump body and to prevent communication via said at least one opening between the inside of the receptacle and the pump chamber;

a second lip situated above the first lip, when the pump is observed in a head-up position, said second lip being configured, at least when the moving assembly is in an end-of-stroke position inside the pump body, to press in a leaktight manner against the pump body and to prevent communication via the inside of the pump body and said at least one opening between the inside of the receptacle and the outside; and an annular gasket for interposing between the stationary portion and a top end of a neck of the receptacle on which the pump is to be mounted, said annular gasket enabling ingress of air from outside toward the inside of the receptacle, while preventing a substance contained in the receptacle from flowing to said outside.

2. A pump according to claim 1, said annular gasket comprising a radially-inner portion pressing against the pump body to prevent the substance contained in the receptacle from flowing to said outside, and being suitable for moving away therefrom under an effect of suction to enable ingress of said air from the outside toward the inside of the receptacle.

3. A pump according to claim 1, further comprising a base portion that enables the pump to be fixed on a receptacle, the pump body being fixed on said base portion.

4. A pump according to claim 3, wherein the air intake passage is formed at least in part between the base portion and the pump body.

5. A pump according to claim 1, wherein at least one of the first lip and the second lip is configured to press permanently against the pump body.

6. A pump according to claim 1, wherein the first lip has a substantially frustocoincal shape diverging toward the pump chamber.

7. A pump according to claim 1, wherein the second lip has an arcuate shape that is concave toward an inside surface of the pump body, pressing via bottom and top edges against the pump body.

8. A pump according to claim 1, wherein the moving assembly comprises an outlet passage for the substance and a shutter configured to close said outlet passage while the volume of the pump chamber is increasing and to open said outlet passage while the volume of the pump chamber is decreasing, and once a pressure of said substance inside the pump chamber has reached a predetermined value.

9. A pump according to claim 8, wherein the moving assembly has an inside space into which the substance outlet passage opens, the shutter being disposed in the inside space.

10. A pump according to claim 8, wherein the shutter comprises a tubular body closed at a top end thereof by a substantially frustoconical portion suitable for closing the substance outlet passage.

11. A pump according to claim 10, wherein the shutter further comprises an annular lip outside the tubular body and suitable for pressing against a wall defining the inside space, said annular lip having, when the pump is observed in a head-up position, a shape that is substantially frustoconical, diverging upward and situated beneath the passage(s) putting the inside space into communication with the pump chamber.

12. A pump according to claim 9, wherein the shutter is urged into a closed position by a resilient return element disposed in the inside space.

13. A pump according to claim 1, comprising a resilient return element suitable for returning the moving assembly into a rest position.

14. A pump according to claim 13, wherein the resilient return element is disposed in the pump chamber.

15. A pump according to claim 1, wherein the pump body is configured to enable a dip tube to be fixed thereto.

16. A pump according to claim 15, further comprising a suction check valve that closes while the volume of the pump chamber is decreasing and that opens while the volume of the pump chamber is increasing, wherein said check valve is configured to enable the pump chamber to be fed with said substance via the dip tube when the pump is used in a head-up position.

17. A pump according to claim 3, wherein the pump body is fixed on said base portion by snap-fastening.

18. A pump according to claim 5, wherein both the first lip and the second lip press permanently against the pump body.

19. A pump according to claim 12, wherein said resilient return element comprises a spring working in compression.

20. A receptacle fitted with a pump according to claim 1.

21. A pump according to claim 19, wherein said spring comprises a helical spring.

22. A pump according to claim 1, said gasket being configured so as to leave a clearance between the gasket and the pump body that is sufficiently small to prevent the substance from passing, while still allowing said air to pass.

23. A pump for fixing on a receptacle, the pump comprising:

a stationary portion comprising a pump body;

a moving assembly movable relative to the pump body and co-operating therewith to define a pump chamber of variable volume;

at least one opening in the pump body that enables the pump chamber to communicate with an inside of the receptacle and is configured to enable the pump to operate in a head-down position;

an air intake passage between the stationary portion and the moving assembly, said intake passage being distinct from said at least one opening;

a first lip configured, after displacement of the moving assembly from a rest position in a substance-dispensing direction, to press in a leaktight manner against the pump body and to prevent communication via said at least one opening between the inside of the receptacle and the pump chamber; and a second lip situated above the first lip, when the pump is observed in a head-up position, said second lip being configured, at least when the moving assembly is in an end-of-stroke position inside the pump body, to press in a leaktight manner against the pump body and to prevent communication via the inside of the pump body and said at least one opening between the inside of the receptacle and the outside, wherein the moving assembly comprises an outlet passage for the substance and a shutter configured to close said passage while the volume of the pump chamber is increasing and to open said outlet passage while the volume of the pump chamber is decreasing, and once the pressure of a substance inside the pump chamber has reached a predefined value, wherein the shutter comprises a tubular body closed at a top end thereof by a substantially frustoconical portion suitable for closing the substance outlet passage, the shutter further comprising an annular lip outside the tubular body and suitable for pressing against a wall defining the inside space, said annular lip having, when the pump is observed in a head-up position, a shape that is substantially frustoconical, diverging upward and situated beneath the passage(s) putting the inside space into communication with the pump chamber.

24. A pump for fixing on a receptacle, the pump comprising:

a stationary portion including a pump body;

a moving assembly movable relative to the pump body and co-operating therewith to define a pump chamber of variable volume;

at least one opening in the pump body enabling the pump chamber to communicate with the inside of the receptacle and disposed in such a manner as to enable the pump to operate in the head-down position;

a second opening, distinct from the at least one opening, wherein the second opening defines a seat for a suction check valve comprising a ball to operate in a head-up position;

an air intake passage between the stationary portion and the moving assembly, said passage being distinct from said opening;

a first lip arranged, after displacement of the moving assembly from a rest position in the substance-dispensing direction, to press in leaktight manner against the pump body and to prevent communication via said opening between the inside of the receptacle and the pump chamber;

a second lip situated above the first, when the pump is observed in the head-up position, said second lip being arranged, at least when the moving assembly is in an end-of-stroke position inside the pump body, to press in leaktight manner against the pump body and prevent communication via the inside of the pump body and said opening between the inside of the receptacle and the outside; and a base portion, configured for mounting on a receptacle, the pump body being fixed on said base portion, the air intake passage being formed at least in part between the base portion and a top end of the pump body.

25. A pump according to claim 24, the pump body being fixed on said base portion by snap-fastening.

26. A pump according to claim 24, wherein at least one of the first and second lips is arranged to press permanently against the pump body.

27. A pump according to claim 24, wherein the first lip presents a substantially frustoconical shape diverging towards the pump chamber.

28. A pump according to claim 24, wherein the second lip presents an arcuate shape that is concave towards the inside surface of the pump body, pressing via bottom and top edges against the pump body.

29. A pump according to claim 24, wherein the moving assembly includes an outlet passage for the substance and a shutter arranged to close said passage while the volume of the pump chamber is increasing and to release said passage while the volume of the pump chamber is decreasing, and once the pressure of the substance inside the pump chamber has reached a predefined value.

30. A pump according to claim 29, wherein the moving assembly has an inside space into which the substance outlet passage opens out and in which the shutter is disposed.

31. A pump according to claim 29, wherein the shutter comprises a tubular body closed at its top end by a substantially frustoconical portion suitable for closing the substance outlet passage.

32. A pump according to claim 31, wherein the shutter further includes an annular lip outside the tubular body and suitable for pressing against a wall defining the inside space, said annular lip presenting, when the pump is observed in the head-up position, a shape that is substantially frustoconical, diverging upwards and situated beneath the outlet passage putting the inside space into communication with the pump chamber.

33. A pump according to claim 30, wherein the shutter is urged into its closed position by a resilient return element disposed in the inside space.

34. A pump according to claim 24, including a resilient return element suitable for returning the moving assembly into its rest position.

35. A pump according to claim 34, wherein the resilient return element is disposed in the pump chamber.

36. A pump according to claim 24, wherein the pump body is arranged to enable a dip tube to be fixed thereto.

37. A pump according to claim 36, including a suction check valve that closes while the volume of the pump chamber is decreasing and that opens while the volume of the pump chamber is increasing, wherein this check valve is disposed in such a manner as to enable the pump chamber to be fed with substance via the dip tube when the pump is used in the head-up position.

38. A pump according to claim 26, wherein both lips press permanently against the pump body.

39. A pump according to claim 33, wherein the resilient return element is a helical spring working in compression.

40. A pump according to claim 24, wherein the base portion comprises a central portion having two tubular walls interconnected by an annular wall at their top end, thereby defining a downwardly annular groove in which the pump body is engaged.

41. A pump according to claim 24, wherein the radially-outer tubular wall has a bead on its radially inside face enabling the pump body to be snap-fastened to the base portion, the pump body being provided for this purpose with an annular bead at its stop end.

42. A pump according to claim 24, wherein the base portion comprises an assembly skirt for securing to the neck of the receptacle.

43. A pump according to claim 24, wherein the pump body is fixed in said base portion independently of the receptacle.

44. A receptacle fitted with a pump according to claim 24.

45. A pump according to claim 24, comprising an endpiece for securing a dip tube, said endpiece having an inlet port different than said at least one opening.

46. A pump for fixing on a receptacle, the pump comprising:

a stationary portion comprising a pump body;

a moving assembly movable relative to the pump body and co-operating therewith to define a pump chamber of variable volume;

at least one opening in the pump body enabling the pump chamber to communicate with the inside of the receptacle and configured to enable the pump to operate in a head-down position;

a second opening, distinct from the at least one opening, wherein the second opening defines a seat for a suction check valve comprising a ball operation in a head-up position;

an air intake passage between the stationary portion and the moving assembly, said passage being distinct from said opening;

a first lip configured, after displacement of the moving assembly from a rest position in the substance-dispensing direction, to press in leaktight manner against the pump body and to prevent communication via said opening between the inside of the receptacle and the pump chamber;

a second lip situated above the first, when the pump is observed in the head-up position, said second lip being configured, at least when the moving assembly is in an end-of-stroke position inside the pump body, to press in leaktight manner against the pump body and prevent communication via the inside of the pump body and said opening between the inside of the receptacle and the outside; and a base portion enabling the pump to be fixed on a receptacle, wherein the pump body is fixed in said base portion independently of the receptacle.

47. A pump according to claim 46, comprising an endpiece for securing a dip tube, said endpiece having an inlet port different than said at least one opening.

* * * * *